US009383675B2

(12) United States Patent
Murayama

(10) Patent No.: US 9,383,675 B2
(45) Date of Patent: Jul. 5, 2016

(54) IMAGE PROCESSING DEVICE AND METHOD OF ACQUIRING AMOUNT OF POSITIONAL DEVIATION OF LIGHT-EMITTING-ELEMENT ARRAY

(71) Applicant: Kentaro Murayama, Kasugai (JP)

(72) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/191,635

(22) Filed: Feb. 27, 2014

(65) Prior Publication Data

US 2014/0240431 A1 Aug. 28, 2014

(30) Foreign Application Priority Data

Feb. 27, 2013 (JP) ..... 2013-036899

(51) Int. Cl.
*G03G 15/04* (2006.01)

(52) U.S. Cl.
CPC ..... *G03G 15/04054* (2013.01)

(58) Field of Classification Search
CPC ..... B41J 19/205
See application file for complete search history.

(56) References Cited

U.S. PATENT DOCUMENTS 6,134,022 A * 10/2000 Yamamoto ..... H04N 1/506 347/235
9,079,421 B2 7/2015 Kato et al.
2003/0001914 A1 1/2003 Matsumoto et al.
2005/0062830 A1 3/2005 Taki et al.
2008/0192319 A1 8/2008 Miyatake et al.
2009/0091805 A1 4/2009 Tanabe et al.
2010/0074638 A1* 3/2010 Murayama ..... 399/31
2011/0181679 A1 7/2011 Arai et al.
2012/0026229 A1 2/2012 Kato et al.
2012/0147114 A1 6/2012 Yokoyama et al.

(Continued)

FOREIGN PATENT DOCUMENTS

JP H05-84972 A 4/1993
JP 2001-219594 A 8/2001

(Continued)

OTHER PUBLICATIONS

Jan. 15, 2015—(US) Non-Final Office Action—U.S. Appl. No. 14/190,119.

(Continued)

*Primary Examiner* — An Do
*Assistant Examiner* — Renee I Wilson
(74) *Attorney, Agent, or Firm* — Banner & Witcoff, Ltd.

(57) ABSTRACT

An image forming section includes a bearing member configured to bear an image, and a light-emitting-element array having a plurality of light emitting elements arranged linearly in an arrangement direction. The image forming section is configured to form an image on the bearing member by using the plurality of light emitting elements to form the image on a sheet. A reader is configured to read an image formed on a sheet. A memory stores instructions, the instructions, when executed by a processor, causing the processor to perform: a pattern reading process of controlling the reader to read a sheet on which a pattern image is formed, the pattern image being an image for detecting positional deviation of the light-emitting-element array; and a deviation calculating process of calculating an amount of positional deviation of the light-emitting-element array based on a reading result by the pattern reading process.

18 Claims, 10 Drawing Sheets

(56) References Cited

U.S. PATENT DOCUMENTS

| | | | |
|---|---|---|---|
| 2013/0155164 | A1 | 6/2013 | Kamei |
| 2014/0240800 | A1 | 8/2014 | Murayama |

FOREIGN PATENT DOCUMENTS

| | | | |
|---|---|---|---|
| JP | 2002-079657 | A | 3/2002 |
| JP | 2005-077358 | A | 3/2005 |
| JP | 2005-088371 | A | 4/2005 |
| JP | 2006-256050 | A | 9/2006 |
| JP | 2008-132741 | A | 6/2008 |
| JP | 2011-178063 | A | 9/2011 |
| JP | 2011-245802 | A | 12/2011 |
| JP | 2012-020487 | A | 2/2012 |
| JP | 2012-030512 | A | 2/2012 |

OTHER PUBLICATIONS

Feb. 2, 2016—(JP) Office Action in App No. 2011-003097.

* cited by examiner

IMAGE PROCESSING DEVICE AND METHOD OF ACQUIRING AMOUNT OF POSITIONAL DEVIATION OF LIGHT-EMITTING-ELEMENT ARRAY

CROSS-REFERENCE TO RELATED APPLICATIONS

This application claims priority from Japanese Patent Application No. 2013-036899 filed Feb. 27, 2013. The entire content of the priority application is incorporated herein by reference.

TECHNICAL FIELD

The invention relates to an image processing device and a method of acquiring an amount of positional deviation of a light-emitting-element array by the image processing device.

BACKGROUND

It is conventionally known that an exposure device equipped in an electro-photographic-type image forming apparatus uses a light-emitting-element array in which a plurality of light emitting elements is arranged linearly. It is also known to acquire a correction value of the amount of positional deviation of the light-emitting-element array etc., and to use the correction value to perform image processing of adjusting the lighting timing and the light emitting amount of light emitting elements.

SUMMARY

As technology of acquiring the correction value of the light-emitting-element array as described above, a position detecting device is disclosed. In this position detecting device, the inspection target is a product structure having a plurality of light-emitting-element arrays. The positional relationships of each light-emitting-element array relative to each other are detected, and a gap of the connection between the light-emitting-element arrays is measured.

However, if the above-described external device is used to measure the correction value before the light-emitting-element array is attached to the main body of the image processing device, positional deviation caused by the attachment cannot be reflected in the correction value.

In view of the foregoing, according to one aspect, the invention provides an image processing device. The image processing device includes an image forming section, a reader, a processor, and a memory. The image forming section includes a bearing member configured to bear an image, and a light-emitting-element array having a plurality of light emitting elements arranged linearly in an arrangement direction. The image forming section is configured to form an image on the bearing member by using the plurality of light emitting elements to form the image on a sheet. The reader is configured to read an image formed on a sheet. The memory stores instructions, the instructions, when executed by the processor, causing the processor to perform: a pattern reading process of controlling the reader to read a sheet on which a pattern image is formed, the pattern image being an image for detecting positional deviation of the light-emitting-element array; and a deviation calculating process of calculating an amount of positional deviation of the light-emitting-element array based on a reading result by the pattern reading process.

According to another aspect, the invention also provides a method of acquiring an amount of positional deviation of a light-emitting-element array mounted on an image processing device. The light-emitting-element array has a plurality of light emitting elements arranged linearly. The method includes: controlling a reader to read a sheet on which a pattern image is formed, the pattern image being an image for detecting positional deviation of the light-emitting-element array; and calculating an amount of positional deviation of the light-emitting-element array based on a reading result by the reader.

BRIEF DESCRIPTION OF THE DRAWINGS

Embodiments in accordance with the invention will be described in detail with reference to the following figures wherein.

DETAILED DESCRIPTION

Embodiments of the invention will be described in detail while referring to drawings. In the present embodiment, the invention is applied to a multifunction peripheral (MFP) having an image reading function and an image forming function.

[Configuration of MFP]

Figure 1:
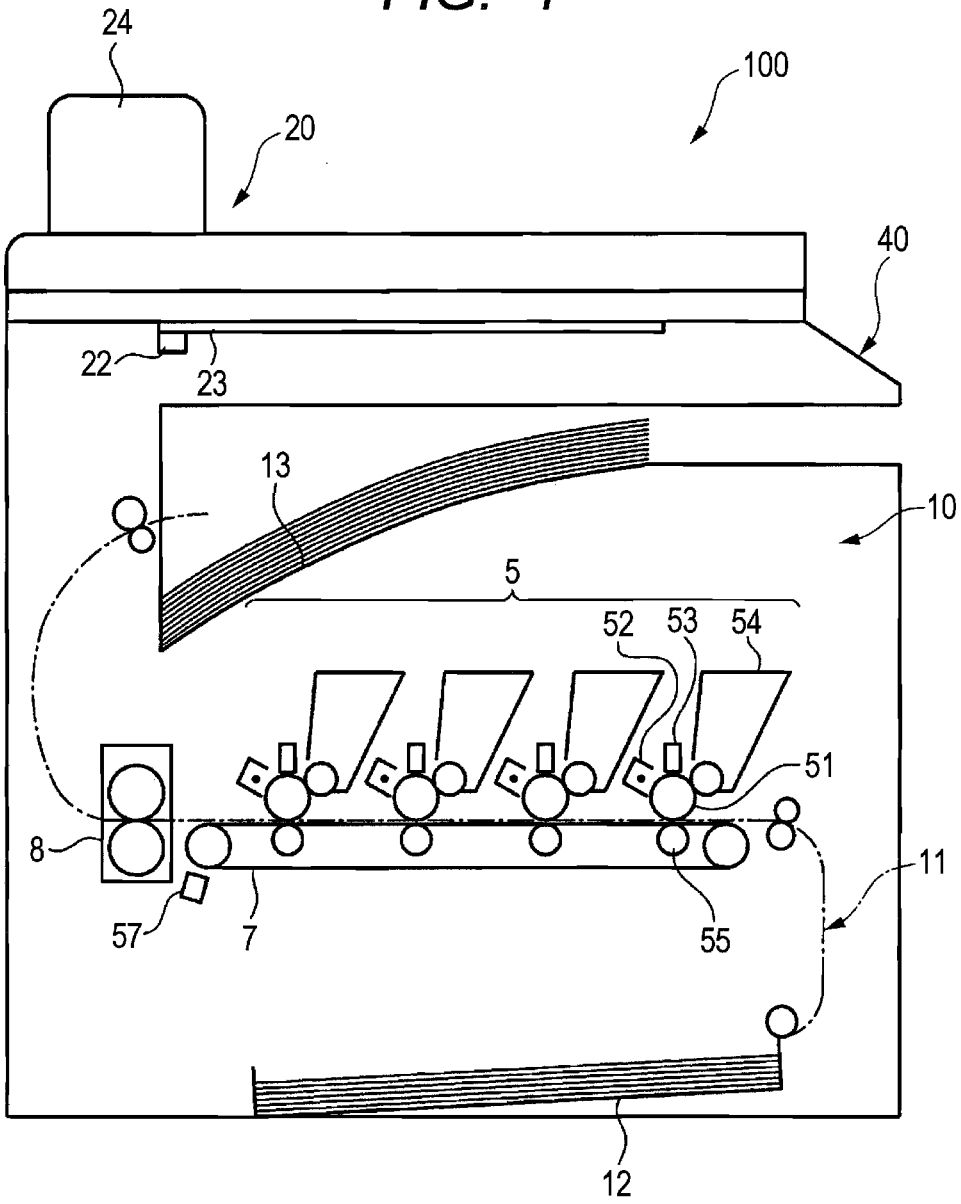
FIG. 1 is a cross-sectional view showing the schematic configuration of an MFP according to an embodiment of the invention.

As shown in FIG. 1, the MFP 100 of the present embodiment includes an image forming section 10 that prints an image on a sheet, an image reading section 20 that reads an image on an original document, and an operation panel 40 that displays an operation status and that receives an input operation by a user. The image forming section 10 is an example of an image forming section, and the image reading section 20 is an example of a reader.

The image forming section 10 includes a processing section 5 that forms a toner image on a sheet by an electrophotographic method, a conveying belt 7 that conveys the sheet, a fixing section 8 that fixes the unfixed toner image on the sheet, a paper supplying tray 12, and a paper discharging tray 13. The processing section 5 includes a photosensitive member 51, a charging section 52, an exposing section 53, a developing section 54, and a transfer section 55 for each color of yellow (Y), magenta (M), cyan (C), and black (K). Further, a conveying path 11 is formed in the apparatus, along which a sheet supplied from the paper supplying tray 12 passes through the processing section 5 and the fixing section 8, and is discharged to the paper discharging tray 13. The photosensitive member 51 is an example of a bearing member. The conveying belt 7 and the conveying path 11 serve as an example of a conveyer. A sheet conveying direction is a direction in which a sheet is conveyed by the conveyer.

At the time of image formation, the photosensitive member 51 is charged by the charging section 52, and is exposed by the exposing section 53. With this operation, an electrostatic latent image based on image data is formed on a surface of the photosensitive member 51. Further, the electrostatic latent image is developed with toner supplied by the developing section 54, so that a toner image is formed on the photosensitive member 51. On the other hand, a sheet on which an image is to be formed is conveyed to the processing section 5 along the conveying path 11. At that time, the transfer section 55 transfers the toner image onto the sheet from the photosensitive member 51. Subsequently, the toner image borne on the sheet is fixed to the sheet by the fixing section 8. Note that FIG. 1 also shows a sensor 57 for detecting toner on the conveying belt 7.

The image reading section 20 includes an image sensor 22 for optically reading an image, a contact glass 23, and an ADF (automatic document feeder) 24. The image sensor 22 includes optical elements arranged in the direction perpendicular to the drawing sheet of FIG. 1. The image reading section 20 causes the image sensor 22 and an original document sheet on which an image is formed to move relative to each other, thereby reading the image one line at a time. The moving method may be a method of moving the image sensor 22 while the original document sheet is fixed, or may be a method of moving the original document sheet by the ADF 24 while the image sensor 22 is fixed. A main scanning direction of the image reading section 20 is a direction in which the optical elements of the image sensor 22 are arranged. A sub-scanning direction is a direction perpendicular to the main scanning direction, and is a direction in which the sheet moves relative to the image sensor 22.

The image reading section 20 acquires image data based on reflection of light in each position of an original document. For example, image data at that position can be acquired based on the amount of light received by each optical element. Then, based on a reading result by the image reading section 20, the MFP 100 can acquire a position coordinate of the image in a sheet surface. Note that the image reading section 20 may be a type of capable of color reading, or may be a type of only capable of monochromatic reading.

[Configuration of Exposing Section]

Figure 2:
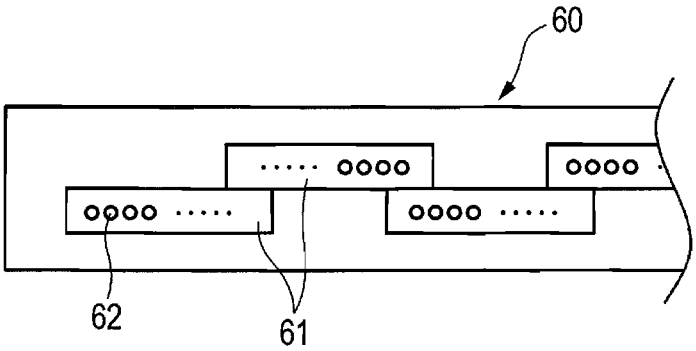
FIG. 2 is an explanatory diagram showing the schematic configuration of an exposing section.
Figure 3:
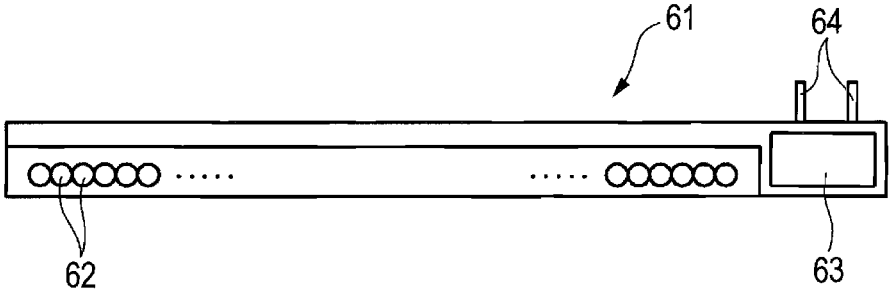
FIG. 3 is an explanatory diagram showing the schematic configuration of an LED unit.

Next, the exposing section 53 of the image forming section 10 will be described. The exposing section 53 includes a light emitting unit 60 having a plurality of light emitting elements that is arranged linearly. As shown in FIG. 2, the light emitting unit 60 of the MFP 100 is, for example, a bar-shaped member in which a plurality of LED units 61 is integrated. As shown in FIG. 3, in each LED unit 61, a plurality of LED elements 62 and a driving circuit 63 are integrally mounted. The plurality of LED elements 62 of the LED unit 61 is arranged along one straight line. Terminals 64 for receiving inputs of signals are connected with the driving circuit 63. The driving circuit 63 drives the LED elements 62 to emit light sequentially from one end side to the other end side.

As shown in FIG. 2, for example, each LED unit 61 of the light emitting unit 60 may be arranged in staggered arrangement along two rows parallel to the longitudinal direction of the light emitting unit 60. In this case, although the plurality of LED elements 62 is actually arranged along two straight lines, this arrangement is also an example of linear arrangement. The LED element 62 is an example of a light emitting element, and both the light emitting unit 60 and the LED unit 61 are examples of a light-emitting-element array.

Preferably, each LED unit 61 of the light emitting unit 60 is driven such that scanning directions are opposite between one row and the other row of the above-described two rows. If the scanning direction is the same for each LED unit 61, end points of scanning do not match regardless of whether there is positional deviation. In contrast, if the scanning directions of the neighboring LED units 61 are opposite, and if there is no positional deviation between the LED units 61, the end points of scanning match at some parts. That is, whether the end points of scanning match can be used as one of criteria for determining whether there is positional deviation. Thus, it is possible to expect improvement of accuracy in determination of whether there is positional deviation.

In the MFP 100, the light emitting unit 60 is mounted such that its longitudinal direction is parallel to the axial direction of the photosensitive member 51. The respective LED elements 62 are turned on and off based on signals inputted from the terminals 64, so that the photosensitive member 51 is exposed one dot row in the axial direction at a time. Note that, in the light emitting unit 60 of the MFP 100, the plurality of LED units 61 is arranged such that no overlap or gap of the LED elements 62 is formed, in the longitudinal direction, between the LED units 61 arranged in two rows.

[Electrical Configuration of MFP]

Figure 4:
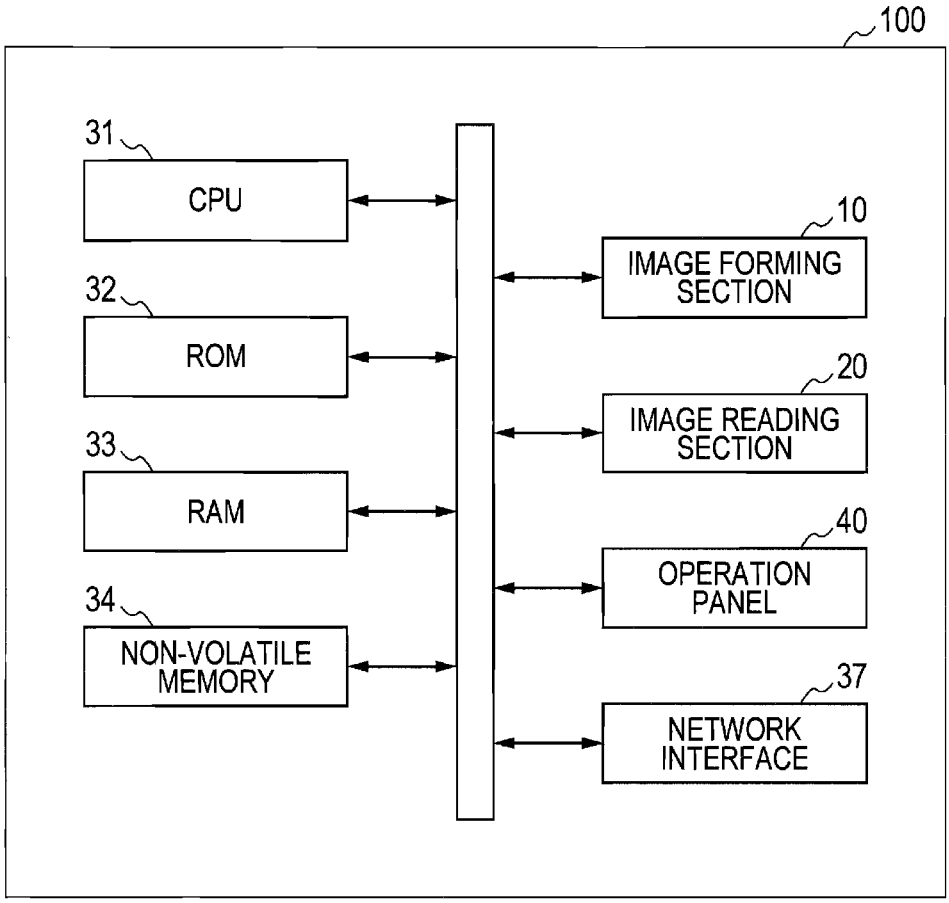
FIG. 4 is a block diagram showing the electrical configuration of the MFP.

Next, the electrical configuration of the MFP 100 will be described. As shown in FIG. 4, the MFP 100 includes a CPU 31, a ROM 32, a RAM 33, and a non-volatile memory 34. Further, the MFP 100 includes a network interface 37 that performs communication with an external device. The CPU 31 is electrically connected with the image forming section 10, the image reading section 20, the operation panel 40, and the network interface 37.

The ROM 32 stores various control programs for controlling the MFP 100, various settings, initial values, a position correction pattern 71 described later, and the like. The RAM 33 is used as a work area from which the various control programs are read out, or as a storage area for keeping print data. The non-volatile memory 34 stores various setting values, amounts of positional deviation described later, and the like. The CPU 31 runs the control programs read out from the ROM 32 while storing the processing results in the RAM 33 or in the non-volatile memory 34, thereby controlling the entirety of the MFP 100. The CPU 31 is an example of a processor.

[Position Correction Pattern]

Figure 5:
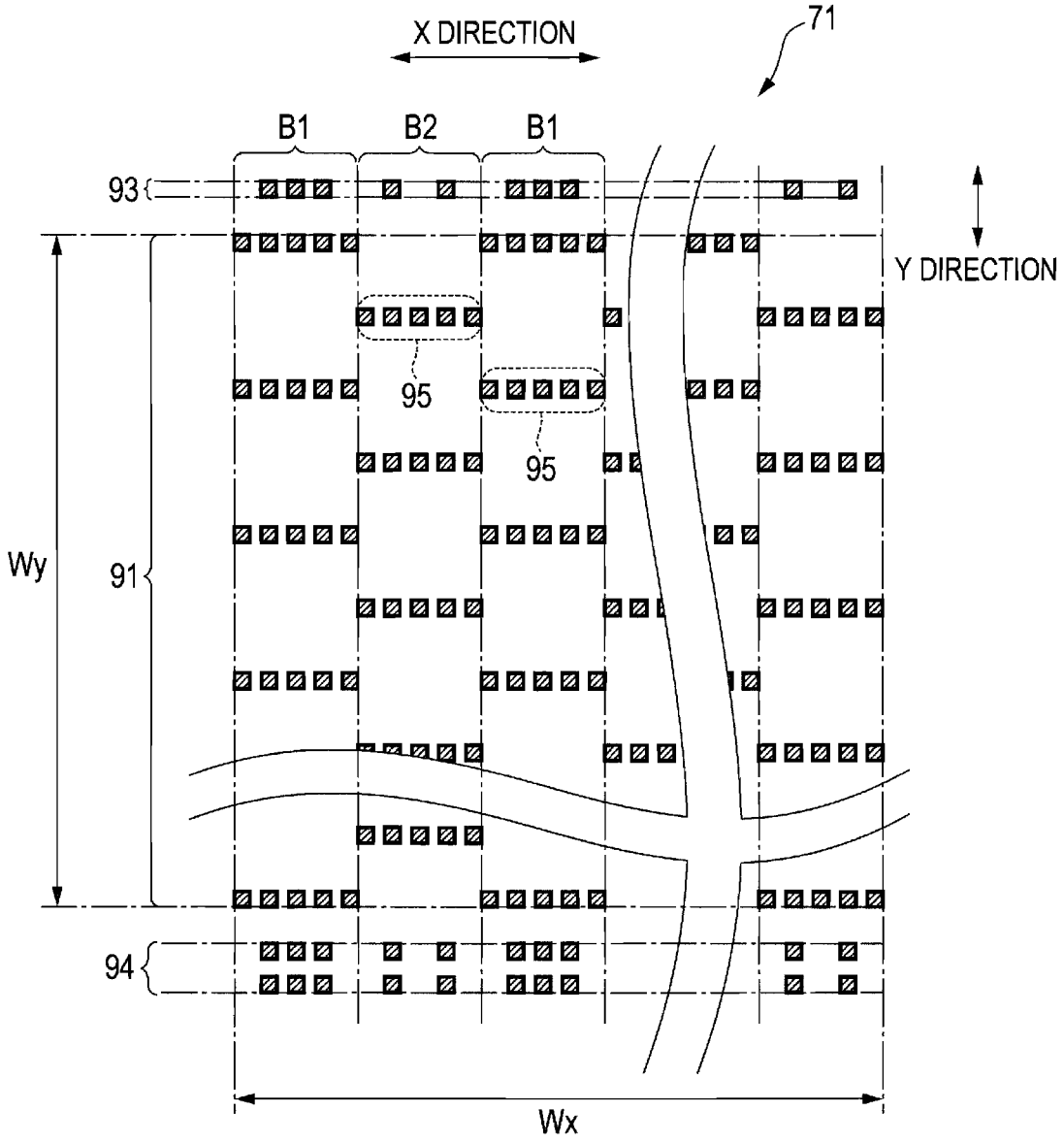
FIG. 5 is an explanatory diagram showing an example of a position correction pattern.

Next, the position correction pattern 71 stored in the ROM 32 will be described. As shown schematically in FIG. 5, the position correction pattern 71 is, for example, printing data including a pattern image 91 and mark images 93, 94. As shown in FIG. 5, the position correction pattern 71 includes a plurality of dot data. Of these, the pattern image 91 is an example of a pattern image for detecting positional deviation, and the mark images 93, 94 are an example of a mark image for detecting position (or orientation).

In the following description, in the position correction pattern 71, Y direction is a direction in which the mark image 93, the pattern image 91, and the mark image 94 are arranged. Further, in the position correction pattern 71, X direction is a direction perpendicular to the Y direction. In FIG. 5, the Y direction is a vertical direction in the drawing. As will be described later, in the MFP 100, an image is printed on a sheet based on the position correction pattern 71 stored in the ROM 32. At the time of printing, the X direction of the position correction pattern 71 is oriented in the arrangement direction of the LED elements 62 in the LED unit 61. Also, the Y direction of the position correction pattern 71 is oriented in a direction perpendicular to the arrangement direction of the LED elements 62 in the LED unit 61. That is, printing is performed in a state where the Y direction of the position correction pattern 71 is oriented in the sheet conveying direction of the image forming section 10.

As dividedly indicated by the single-dot chain lines in FIG. 5, the position correction pattern 71 is divided, in the X direction, into a plurality of blocks corresponding to the number of the LED units 61 of the exposing section 53. There are two types of the blocks of the position correction pattern 71 with respect to the data arrangement, and the two types of the blocks are arranged alternately. In the following description, the two types of blocks are referred to as block B1 and block B2. The width of each block in the X direction corresponds to the entire length occupied by the LED elements 62 in one LED unit 61. Note that, in FIG. 5, the single-dot chain lines shown as borders between the blocks are intended for description purposes, and are not included in print data.

The pattern image 91 of each block includes a plurality of dot patterns 95. Each dot pattern 95 is, for example, a cluster of data having a one-dot width in the Y direction and having a width of the block in the X direction. The entire size of the pattern image 91 is a size Wx in the X direction, and is a size Wy in the Y direction. The size Wx in the X direction corresponds to the entire exposure range of the exposing section 53. The size Wy in the Y direction is larger than or equal to the peripheral length of the photosensitive member 51. Accordingly, when the pattern image 91 is printed, all the LED units 61 of the exposing section 53 and the entire periphery of the photosensitive member 51 are used.

Each dot pattern 95 of the pattern image 91 is an intermittent dot row having a length corresponding to the entire length of the LED elements 62 of each LED unit 61. Each dot pattern 95 includes at least dots corresponding to the LED elements 62 at both ends of the LED unit 61. Each dot pattern 95 is formed by approximately two to ten dots for each LED unit 61, such as equally-spaced five dots, for example. Accordingly, when the pattern image 91 is printed, the LED elements 62 of a number smaller than the number of all the LED elements 62 are used. Note that each dot pattern 95 may have a different shape from the shape shown in FIG. 5, as long as each dot pattern 95 has the same shape. Because the LED elements 62 of a number smaller than the number of all the LED elements 62 are used, an amount of toner consumption can be reduced. Further, because the positions the LED elements 62 at both ends of the LED unit 61 are known from the dot pattern 95, the border of the neighboring LED units 61 can be recognized.

Further, the plurality of dot patterns 95 in one block is arranged uniformly with a predetermined interval in the Y direction. Between the block B1 and the block B2, the arrangement of the dot patterns 95 with respect to the Y direction is different. That is, between neighboring blocks, the dot patterns 95 are arranged at different positions from each other in the Y direction. Accordingly, the dot patterns 95 are printed not to overlap each other between the neighboring blocks. As shown in FIG. 5, for example, in the entirety of the pattern image 91, the plurality of dot patterns 95 is arranged to be a houndstooth shape in which the dot patterns 95 are spaced from one another. Because the dot patterns 95 are printed not to overlap each other between the neighboring blocks, the positions of the LED units 61 in the sheet conveying direction can be obtained accurately.

More specifically, a Y-direction average position of neighboring two dot patterns 95 in the block B1 is equal to a Y-direction position of the dot pattern 95 in the block B2 disposed between the neighboring two dot patterns 95. Further, a Y-direction average position of neighboring two dot patterns 95 in the block B2 is equal to a Y-direction position of the dot pattern 95 in the block B1 disposed between the neighboring two dot patterns 95.

Figure 6:
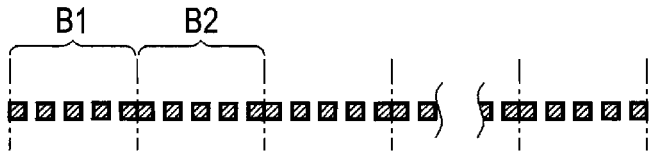
FIG. 6 is an explanatory diagram showing an example of average positions.

Further, all the dot patterns 95 in the pattern image 91 are arranged such that a Y-direction average position of the position coordinate of each dot is the same with respect to the Y direction. That is, if a Y-direction average value of position coordinates is obtained for dots having the same position coordinate with respect to the X direction, the Y-direction average value is the same for both the block B1 and the block B2. In the example of FIG. 5, the dot patterns 95 in the block B1 are arranged at equally-spaced positions including both ends of the pattern image 91 in the Y direction. On the other hand, the dot patterns 95 in the block B2 are arranged at intermediate (center) positions, in the Y direction, of the dot patterns 95 in the block B1. Accordingly, for both of the blocks B1 and B2, the Y-direction average position of the position coordinate of each dot is the center position of the pattern image 91 in the Y direction, and is arranged in one row in the X direction as shown in FIG. 6.

The mark images 93, 94 are arranged outside the pattern image 91 with respect to the Y direction. That is, the pattern image 91 is interposed between the mark image 93 and the mark image 94 with respect to the Y direction. Each of the mark images 93, 94 is a figure that is symmetrical with respect to a center line of each block, with respect to the X direction. For each block, the mark image 93 and the mark image 94 are located at the same position with respect to the X direction. With respect to the Y direction, for each block, the mark image 93 and the mark image 94 have different numbers of dots or have different sizes.

Further, the mark images 93, 94 are different marks between the block B1 and the block B2. In the example of FIG. 5, in the block B1, the mark image 93 is a mark of three dots including a dot on the center line. In the block B2, the mark image 93 is a mark of two dots at symmetrical positions with respect to the center line interposed therebetween. Further, in the both blocks, the mark image 93 has one row of dots with respect to the Y direction, and the mark image 94 has two rows of dots with respect to the Y direction.

Note that, when the position correction pattern 71 is printed by the image forming section 10 in the orientation shown in FIG. 5, the entirety of one block is formed by using one LED unit 61. Hence, dots at the same position with respect to the X direction are formed by using one LED element 62 corresponding to that position. Further, with respect to the sheet conveying direction at image formation, the mark image 93 is at the upstream side, and the mark image 94 is at the downstream side.

Accordingly, by reading the mark images 93, 94 from a sheet on which the position correction pattern 71 is printed, it is possible to obtain the sheet conveying direction at printing, a range corresponding to each LED unit 61, a border between the LED units 61, and the like. For example, a center line of the LED unit 61 is obtained from an X-direction average value of dots of the mark image 93 and an X-direction average value of dots of the mark image 94. A range obtained by extending a half width of the LED unit 61 to the both sides of this center line in the X direction is a range that is printed by using one LED unit 61.

Figure 7:
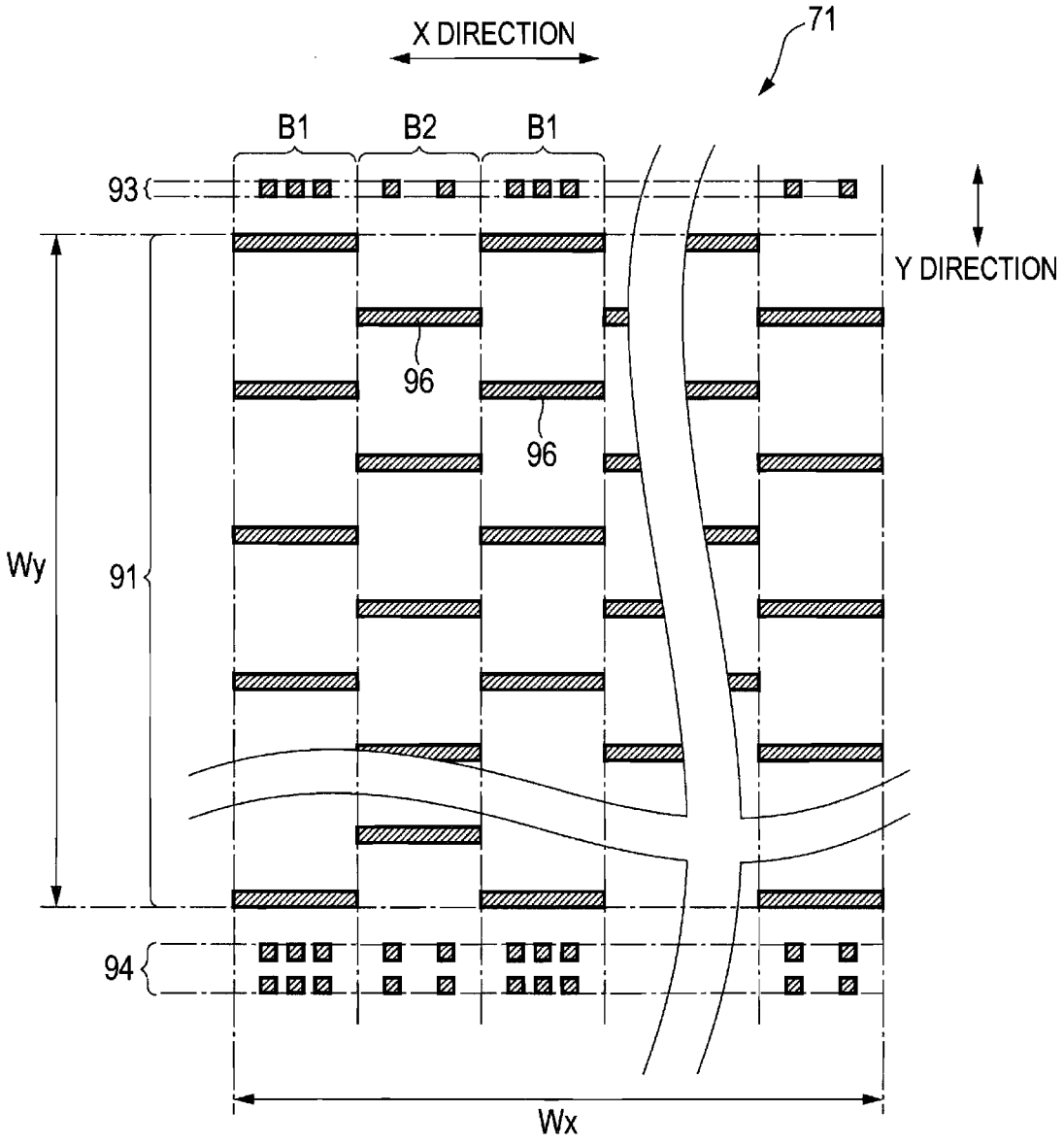
FIG. 7 is an explanatory diagram showing another example of the position correction pattern.

Note that the size of each dot of the dot pattern 95 and the respective mark images 93, 94 is several pixels, for example. The size may be a size that can be formed by the image forming section 10 and that can be read by the image reading section 20. Further, the pattern image 91 is not limited to the dot pattern 95 that is a pattern not using all of the LED elements 62. For example, as shown in FIG. 7, the pattern image 91 may be a line-segment (linear) pattern 96 that is a pattern using all of the LED elements 62 of the LED unit 61. At the time of printing the line-segment pattern 96, all of the LED elements 62 of a corresponding LED unit 61 are lighted. Accordingly, by using the line-segment pattern 96, positional deviation of each LED element 62 can also be obtained.

[Positional Deviation Correction]

As described above, the light emitting unit 60 of the MFP 100 has the plurality of LED units 61. In order to form a toner image based on print data on the photosensitive member 51 without deviation and distortion, it is necessary that all the LED units 61 be correctly mounted at respective expected positions. However, mount positions of the LED units 61 may have positional deviations to some extent.

For example, because the light emitting unit 60 mounted on the MFP 100 is subject to forces from surrounding parts, deflection may be generated in the light emitting unit 60 in some cases. That is, arrangement of the LED units 61 and arrangement of individual LED elements 62 may not necessarily be the same between the light emitting unit 60 prior to being mounted on the MFP 100 and the light emitting unit 60 subsequent to being mounted on the MFP 100. That is, due to the mounting, positional deviation to some extent may be generated in the LED units 61 of the light emitting unit 60.

Hence, the MFP 100 acquires an amount of positional deviation of each LED unit 61 subsequent to assembly or mounting, and stores the acquired amount of positional deviation in the non-volatile memory 34. That is, the LED unit 61 is a unit of acquisition (calculation) of the amount of positional deviation. The MFP 100 acquires and stores the amount of positional deviation, for each color of the processing section 5. By acquiring the amount of positional deviation subsequent to assembly of the MFP 100, a correction amount containing positional deviation caused by mounting can be obtained. Compared with a degree of positional deviation among the plurality of LED units 61, a degree of deviation in arrangement of the LED elements 62 within each LED unit 61 is very small.

At the time of image formation, the MFP 100 adjusts the light emitting amount and lighting timing of each LED element 62 based on the stored amount of positional deviation. Specifically, with respect to deviation in the sheet conveying direction, the lighting timing of each LED element 62 is adjusted. With respect to deviation in the direction perpendicular to the sheet conveying direction, the light emitting amount of each LED element 62 is adjusted. In this way, the MFP 100 obtains an image of smaller deviation, while suppressing effects due to positional deviation of the LED units 61.

Positional-Deviation-Amount Acquiring Process

First Embodiment

Next, a positional-deviation-amount acquiring process for acquiring the amount of positional deviation among each LED unit 61 of the MFP 100 will be described while referring to the flowchart of FIG. 8. This process is executed by the CPU 31, triggered by reception of an input of an updating instruction of correction values by a user's operation on the operation panel 40. For example, this process is executed at the final stage of a manufacture inspection process of the MFP 100, and the user here is an administrator of manufacture, for example.

Upon starting the positional-deviation-amount acquiring process, the CPU 31 of the MFP 100 first controls the image reading section 20 to start a calibration process of the image sensor 22 (S101). This calibration process is a process for correcting brightness and distortion of the image sensor 22 of the image reading section 20. The calibration process requires a certain period of time. Thus, by performing the calibration process in parallel with a pattern writing process (pattern forming process) described later, a processing time of the entire positional-deviation-amount acquiring process can be shortened.

While the image reading section 20 performs the calibration process of the image sensor 22, the CPU 31 of the MFP 100 controls the image forming section 10 to perform density correction in parallel with the calibration process (S102). This process is, for example, a process of forming a toner image of a test patch for density correction, transferring the test patch onto the conveying belt 7, and reading the transferred test patch with the sensor 57 (see FIG. 1), thereby performing adjustments of developing bias, and the like. By performing this density correction prior to printing, generation of blur and bleeding in a printed pattern image can be prevented.

Subsequent to the density correction, the MFP 100 conveys a sheet, and prints an image based on the position correction pattern 71 on the sheet (S103). The position correction pattern 71 is print data stored in the ROM 32. The CPU 31 reads out the position correction pattern 71 from the ROM 32, and controls the image forming section 10 to print the image. Note that, at the time of the printing, it is preferable not to perform a positional-deviation correcting process at the MFP 100 main body side, such as skew correction, for example. With this setting, positional deviation of the LED unit 61 itself appears in an image as it is.

In the pattern writing process of S103, the position correction pattern 71 is printed in such an orientation that the mark images 93, 94 are arranged at the upstream side and at the downstream side of the pattern image 91 with respect to the sheet conveying direction. That is, the sheet conveying direction in the pattern writing process is the Y direction of the position correction pattern 71. Further, the arrangement direction of the LED elements 62 at the time of printing is the X direction of the position correction pattern 71. Accordingly, the mark image 93 and the mark image 94 in the same block are formed by using the same LED elements 62.

Then, the CPU 31 of the MFP 100 determines whether the calibration process of the image sensor 22 started in S101 is finished (S104). If it is determined that the calibration process is not finished (S104: No), the CPU 31 waits until the calibration process is finished. If the calibration process of the image sensor 22 is finished (S104: Yes), the MFP 100 notifies the user to start reading (S105). Specifically, for example, the CPU 31 notifies the user by controlling the operation panel 40 to display a message to set, on the contact glass 23, the sheet on which the position correction pattern 71 is written (formed) in S103 and to press a button for starting reading.

Further, the CPU 31 determines whether an instruction for starting reading of the sheet is received (S106). If the instruction for starting reading of the sheet is not received (S106: No), the CPU 31 waits until the instruction is received. If the instruction for starting reading is received (S106: Yes), the CPU 31 executes a pattern reading process (S107).

Next, steps of the pattern reading process will be described while referring to the flowchart of FIG. 9. This process is started in a state where a sheet on which the position correction pattern 71 is formed in S103 of FIG. 8 is set in the image reading section 20 of the MFP 100.

Upon starting this process, the CPU 31 of the MFP 100 first controls the image reading section 20 to read an image on the sheet (S201). The reading method may be a method of moving the image sensor 22 or may be a method of moving the sheet. Further, the CPU 31 determines whether reading of the image on the sheet is completed (S202). If it is determined that reading of the image on the sheet is not completed (S202: No), reading is continued until reading is completed.

If it is determined that reading of the image on the sheet is completed (S202: Yes), the MFP 100 detects the mark images 93, 94 from the read image data, and acquires position coordinates of the detected mark images 93, 94 (S203). The line connecting the mark images 93, 94 denotes the sheet conveying direction at the time of writing the images. In S203, all the mark images 93, 94 may be extracted, or only a pair of mark images 93, 94 formed in the center part of the sheet may be extracted. Then, the CPU 31 determines whether the mark images 93, 94 are detected normally (S204).

If it is determined that the mark images 93, 94 are not detected normally (S204: No), a reading error is notified (S205). This is a case, for example, in which a sheet is read on which the position correction pattern 71 is not printed. Subsequent to S205, the CPU 31 deletes the read image data (S206), and returns to the positional-deviation-amount acquiring process in FIG. 8.

On the other hand, if it is determined that the mark images 93, 94 are acquired normally (S204: Yes), the pattern reading process is completed normally, and the process returns to the positional-deviation-amount acquiring process in FIG. 8. In some cases, in the read image data, the positional relationship between the mark image 93 and the mark image 94 is opposite from the positional relationship at the time when the mark images 93, 94 are printed. This is a case in which the sheet is set on the contact glass 23 in a state where the sheet is rotated approximately 180 degrees from the sheet conveying direction at the time of printing. In this case, too, it may be determined that the pattern reading process is completed normally and, when a calculation result in a deviation calculating process described later is applied, the sequence of the LED units 61 and the LED elements 62 may be changed.

Figure 8:
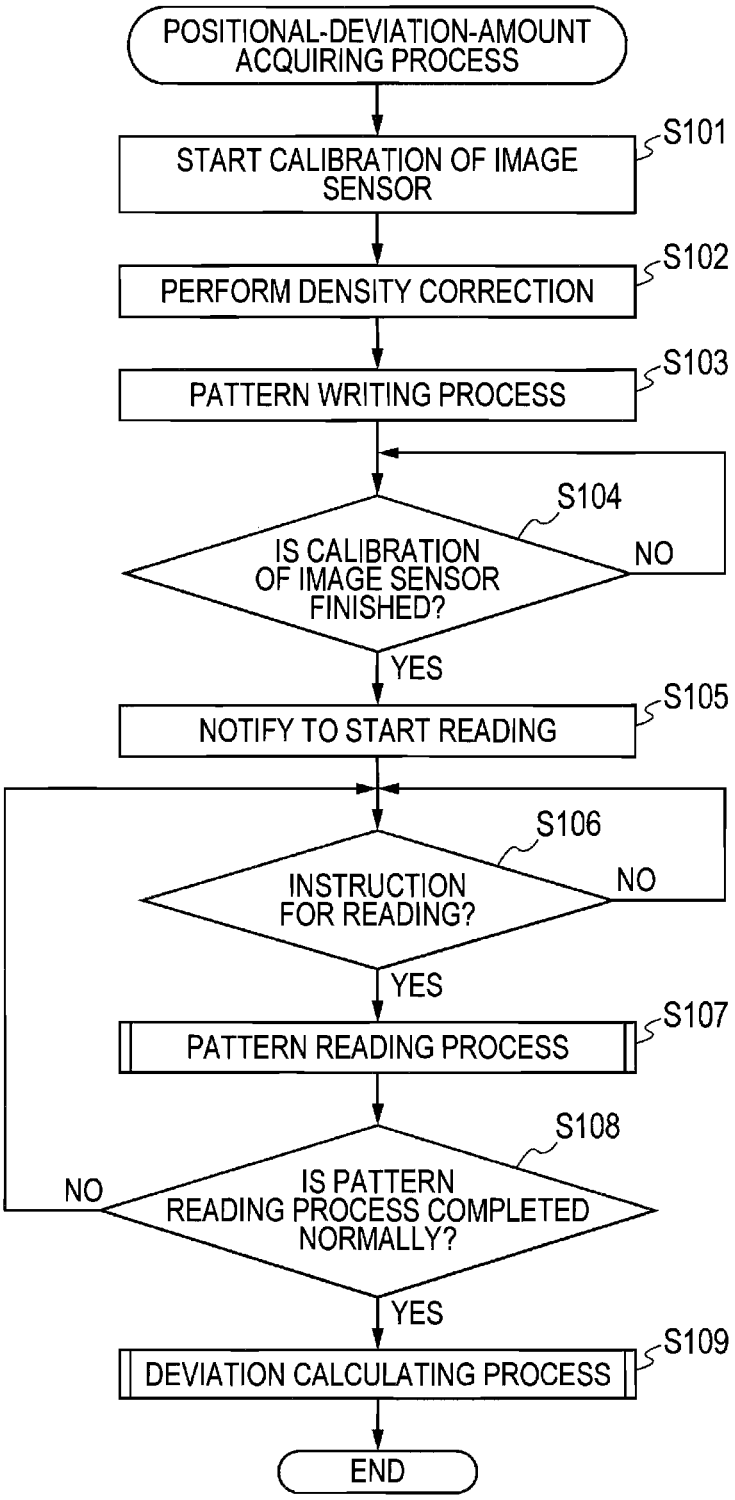
FIG. 8 is a flowchart showing the steps of a positional-deviation-amount acquiring process.
Figure 9:
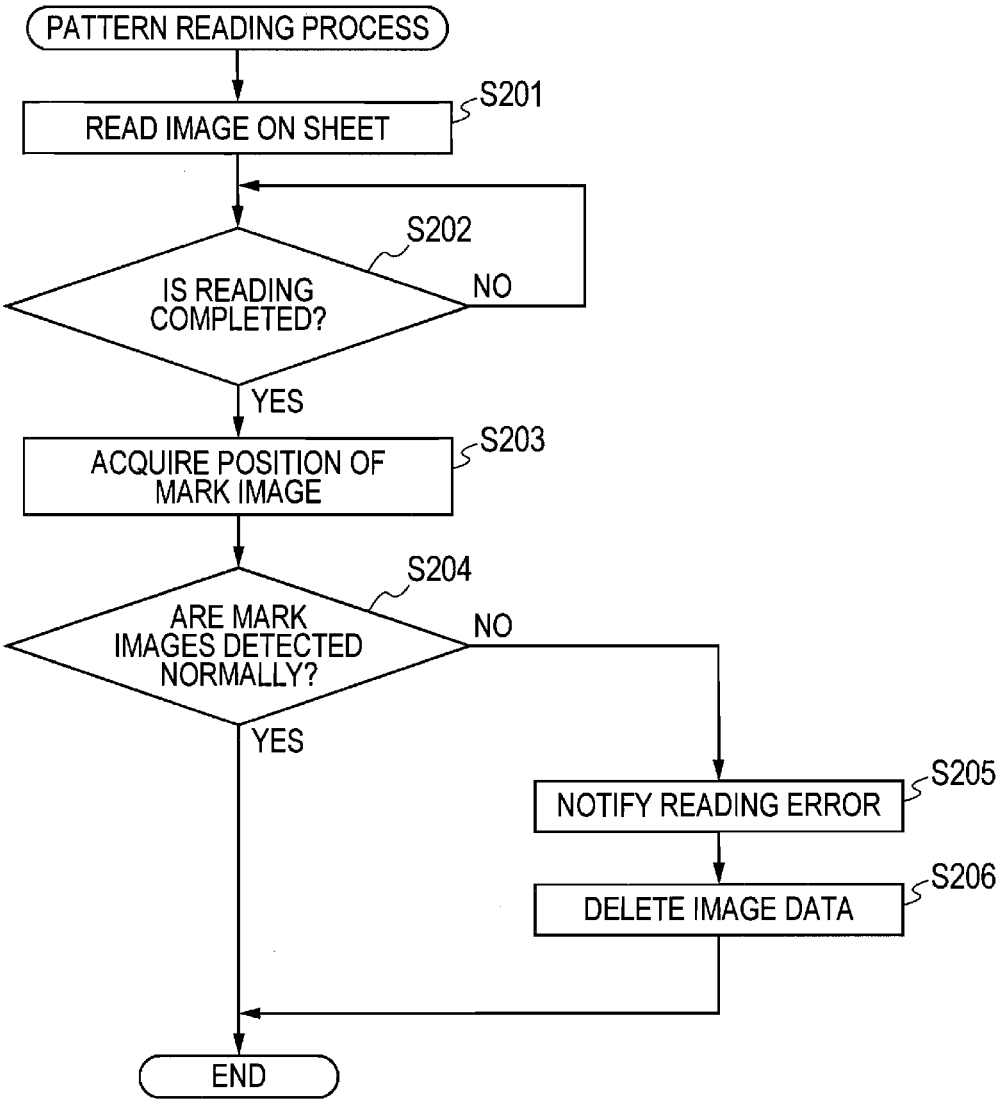
FIG. 9 is a flowchart showing the steps of a pattern reading process.

Returning to the positional-deviation-amount acquiring process in FIG. 8, the CPU 31 determines whether the pattern reading process is completed normally in S107 (S108). That is, in the case of Yes in S204 in FIG. 9, it is determined that the pattern reading process is completed normally (S108: Yes). On the other hand, if the process is returned from S206 in FIG. 9, that is, if no image data is stored in the RAM 33, the pattern reading process is not completed normally (S108: No). Hence, the CPU 31 returns to S106, and waits until a reading instruction is received again.

Figure 10:
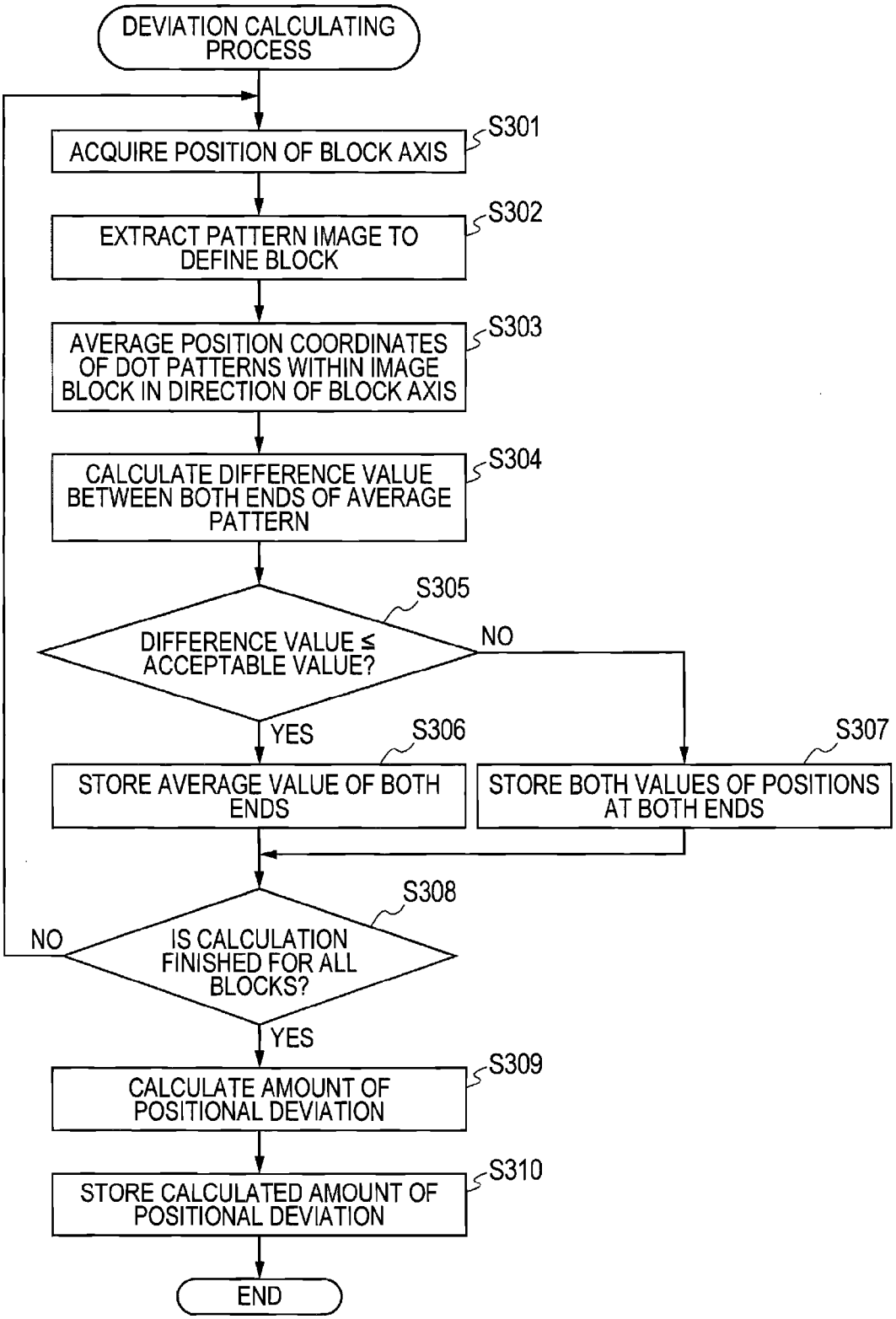
FIG. 10 is a flowchart showing the steps of a deviation calculating process.

If it is determined that the pattern reading process is completed normally (S108: Yes), the CPU 31 executes the deviation calculating process (S109). The steps of the deviation calculating process executed in S109 will be described while referring to the flowchart of FIG. 10. This process is a process for calculating deviation amounts of the LED units 61, based on image data read in the pattern reading process.

Figure 11:
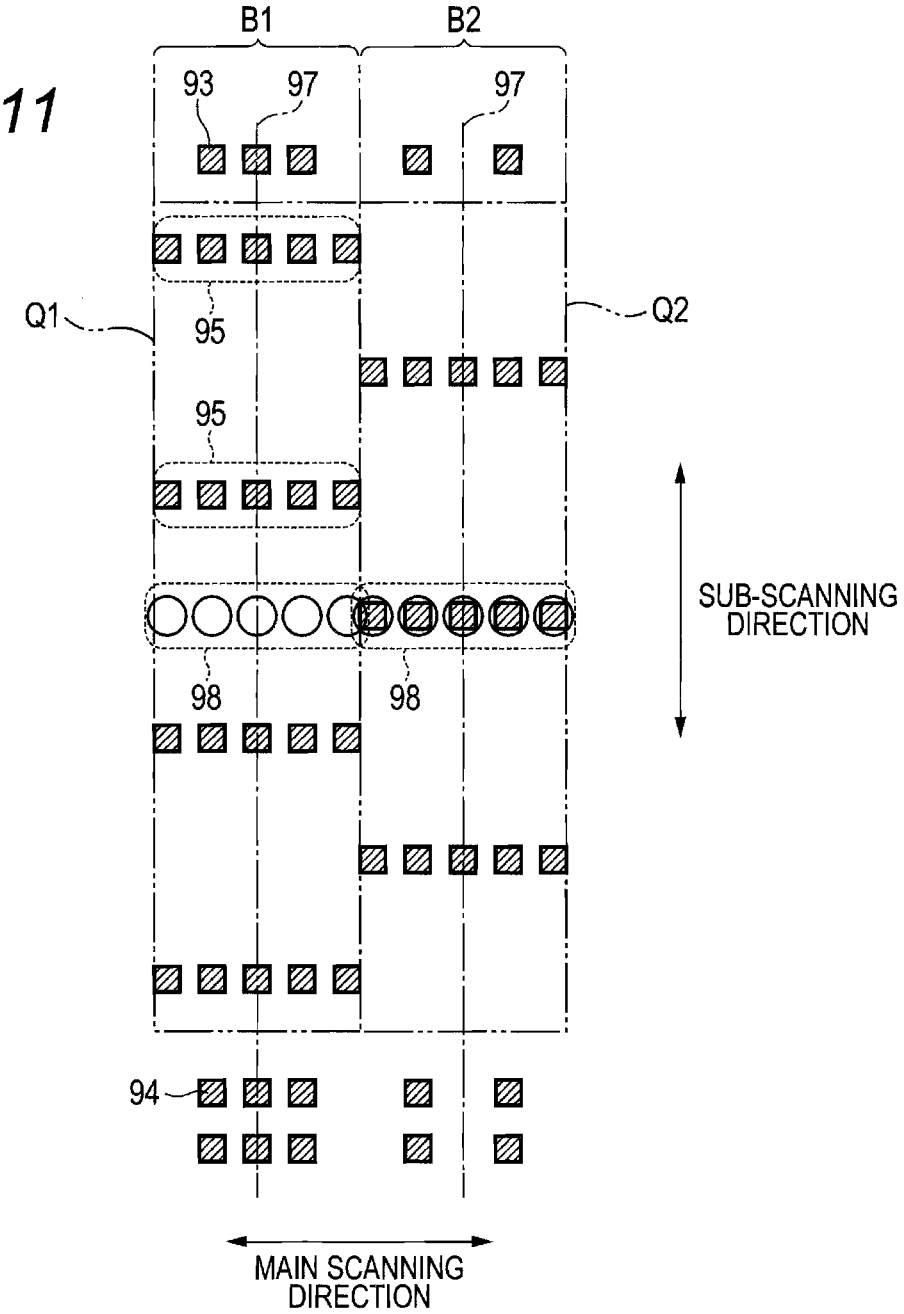
FIG. 11 is an explanatory diagram showing an example of image data.

Here, an example shown in FIG. 11 will be described. For simplicity, this figure illustrates the pattern image 91 including the block B1 having four rows of the dot patterns 95 in the Y direction, and the block B2 having three rows of the dot patterns 95 in the Y direction. In FIG. 11, reading is performed in a state where the arrangement direction of the blocks B1 and B2 in the left-right direction is oriented in the main scanning direction of the image reading section 20. Further, with respect to the sub-scanning direction perpendicular to the main scanning direction, the mark image 93, the pattern image 91, and the mark image 94 are read in this sequence.

First, the CPU 31 of the MFP 100 acquires coordinates of each of the mark images 93, 94, and acquires the position of a block axis 97 (S301). The block axis 97 is the center line, for each block, that connects the center position of the mark image 93 in the main scanning direction and the center position of the mark image 94 in the main scanning direction.

For example, by regarding the mark image 93 within a predetermined range as one group, the CPU 31 calculates the average position of the mark image 93 in the group. Similarly, by regarding the mark image 94 within a predetermined range as one group, the CPU 31 calculates the average position of the mark image 94 in the group. Then, the CPU 31 acquires, as the block axis 97, a straight line connecting the average position of the mark image 93 and the average position of the mark image 94, the average position of the mark image 93 and the average position of the mark image 94 being the closest ones with respect to the main scanning direction. The block axis 97 is a straight line in the sub-scanning direction.

In the example shown in FIG. 11, in the block B1, the block axis 97 is acquired from the average position of three dots of the mark image 93 within the predetermined range and the average position of six dots of the mark image 94 within the predetermined range. Similarly, in the block B2, the block axis 97 is acquired from the average position of two dots of the mark image 93 within the predetermined range and the average position of four dots of the mark image 94 within the predetermined range.

Then, the CPU 31 reads out image data within a range of a predetermined width measured from the block axis 97, and extracts the pattern image 91 from the image data, thereby defining a block (S302). That is, a predetermined range measured from the block axis 97 in the main scanning direction is regarded as one block, and this block is associated with the corresponding LED unit 61. For example, as indicated by the double-dot chain lines in FIG. 11, a range of the pattern image 91 in the block B1 is referred to as an image block Q1, and a range of the pattern image 91 in the block B2 is referred to as an image block Q2.

Of the dot patterns 95 in the image blocks Q1 and Q2, dots located at the same position with respect to the main scanning direction are formed by using the same one LED element 62. Hence, the CPU 31 acquires the position coordinate of each dot included in the dot patterns 95 within the extracted image blocks Q1 and Q2, and detects an arrangement state of the LED units 61 based on these position coordinates. In order to do this, the CPU 31 executes a converting process of converting a part corresponding to the pattern image 91 in the read image into a detection image for detecting the arrangement state. This converting process in the deviation calculating process may be, for example, an averaging process of calculating an average value of the position coordinate of each dot with respect to the sub-scanning direction. That is, the dot patterns 95 within the image blocks Q1 and Q2 defined in S302 are averaged in the direction of the block axis 97 (S303). More specifically, the dots located at the same position with respect to the main scanning direction (that is, the dots formed by the same LED element 62) are averaged.

As shown in FIG. 11, in S303, an average pattern 98 for each block Q1, Q2 is created. In FIG. 11, the average value of dots of the dot pattern 95 is indicated by a circle ("○"). As described above, the pattern image 91 of the position correction pattern 71 is created such that the average value of the position coordinate of each dot in the Y direction is aligned on a straight line. Accordingly, the average pattern 98 of the blocks Q1 and Q2 is arranged in one row, if there is no positional deviation of the used LED unit 61.

In the deviation calculating process, it is preferable to divide image data into a plurality of blocks with respect to the main scanning direction of a reading process, and to sequentially process the blocks starting from the block at one end. For example, the CPU 31 extracts, as one block, a part of the position correction pattern 71 that can be determined to be formed by one LED unit 61 in a writing process, and performs an averaging process for an image within that block. In this way, by processing one part of image data at a time, an excessive burden on the CPU 31 can be suppressed. Further, because the amount of positional deviation is calculated based on a result of the averaging process, calculation errors due to expansion/contraction of a sheet, an error in sheet conveying speed due to the photosensitive member 51, the conveying belt 7, etc. can be suppressed.

Further, the CPU 31 calculates a difference value between coordinates of dots at both ends of the average pattern 98 (S304). This operation enables a grasp of a degree of skew of the average pattern 98 relative to the direction perpendicular to the block axis 97. Note that more detailed determination may be performed by using positions of dots other than at the both ends. Or, in S303, average position coordinates may be acquired for only the dots at the both ends of the dot pattern 95.

Then, the CPU 31 determines whether the difference value acquired in S304 is within a predetermined acceptable value (S305). If it is determined that the difference value is smaller than or equal to the acceptable value, that is, the skew of the average pattern 98 is within the acceptable range (S305: Yes), the CPU 31 stores, in the RAM 33, an average value of position coordinates of dots at the both ends in the average pattern 98 (S306). Alternatively, the CPU 31 may store the position coordinate of one dot of the average pattern 98 (for example, a center dot of the average pattern 98). In contrast, if it is determined that the difference value is large, that is, the skew of the average pattern 98 is outside the acceptable range (S305: No), the CPU 31 stores, in the RAM 33, both position coordinates of dots at the both ends in the average pattern 98 (S307).

Figure 12:
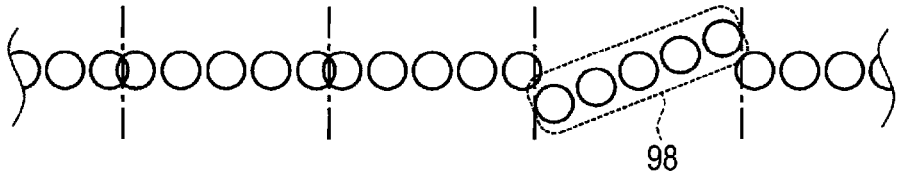
FIG. 12 is an explanatory diagram showing an example of deviation from an average position in the position correction pattern.

As shown in FIG. 11, if the average pattern 98 in a block is arranged in one row in the main scanning direction, it can be determined that each dot pattern 95 is formed to be aligned in the main scanning direction. That is, it can be determined that the skew relative to the arrangement direction of the LED unit 61 is not large. Hence, it is sufficient that only an average value of dots at both ends be stored as an indicator of arrangement of the LED unit 61. This reduces a burden on the memory. However, for a block with large skew of the average pattern 98 as shown in FIG. 12, for example, it is preferable to store both positions of dots at both ends of the average pattern 98 so that correction can be performed by allowing for the skew at the time of image formation.

Further, the CPU 31 determines whether calculation of the average pattern 98 is finished for all the blocks of the read image data (S308). If it is determined that the calculation is not finished (S308: No), the CPU 31 returns to S301 and performs calculation for the next block in a similar manner (S301 through S307). Because each block corresponds to one of the LED units 61, the CPU 31 repeats the steps S301 through S307 by the number of times corresponding to the number of the LED units 61 included in the light emitting unit 60 of the exposing section 53.

If it is determined that calculation is finished for all the blocks (S308: Yes), the CPU 31 calculates a difference between a value stored in S306 or S307 and an aggregate average value which is the average for all the blocks, that is, the amount of positional deviation in the Y direction (S309). Note that values of a block with large skew stored in S307 may be excluded from calculation of the aggregate average value. Further, the CPU 31 stores the amount of positional deviation calculated in S309 in the non-volatile memory 34 (S310). Then, the deviation calculating process ends. In this way, the difference between the average value of each block and the aggregate average value of the entire pattern image 91 is calculated, which improves reliability of the calculated amount of positional deviation. Here, the amount of positional deviation is not limited to the difference between the value stored in S306 or S307 and the aggregate average value, but may be a difference between neighboring blocks.

Second Embodiment

Figure 13:
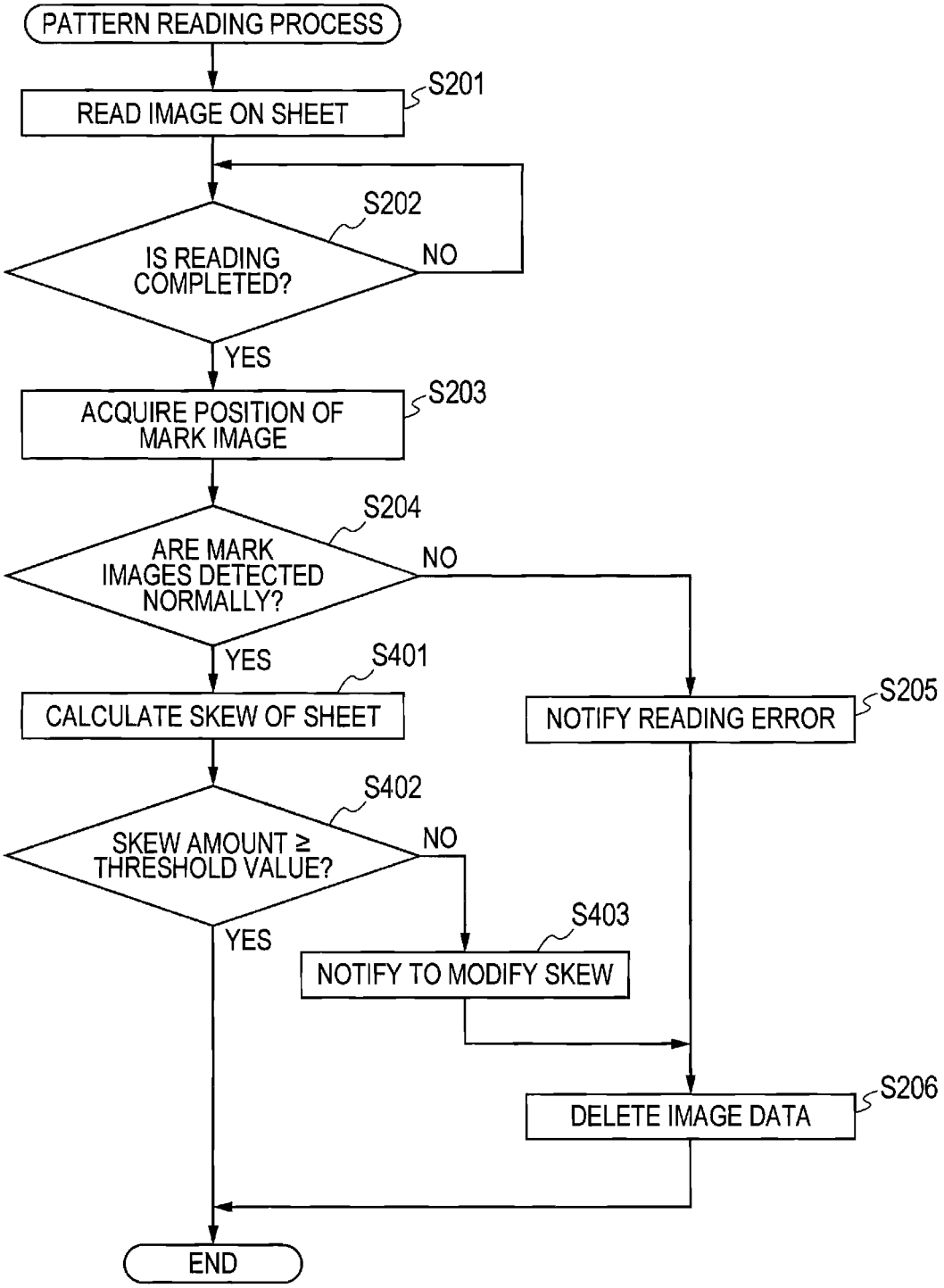
FIG. 13 is a flowchart showing the steps of a pattern reading process according to a second embodiment.

Next, a positional-deviation-amount acquiring process according to a second embodiment will be described while referring to the flowchart of FIG. 13. In the positional-deviation-amount acquiring process of the second embodiment, the pattern reading process of the first embodiment shown in FIG. 9 is replaced with a pattern reading process shown in FIG. 13. The processes other than the pattern reading process are the same as those in the first embodiment. Specifically, in the pattern reading process, reading is performed in a state where a sheet is skewed (inclined). In this regard, the second embodiment differs from the first embodiment in which a sheet is not skewed. Here, in the positional-deviation-amount acquiring process of the second embodiment, the same processes as those in the first embodiment are designated by the same reference numerals to avoid duplicating description. That is, only the pattern reading process will be described.

If the sheet conveying direction at the time of writing matches the sub-scanning direction at the time of reading, all the dot images formed by one LED element 62 are read by the same optical element in the image sensor 22. In the present embodiment, reading is performed while a sheet is skewed slightly within a sheet surface, so that the main scanning direction at the time of reading does not match the arrangement direction of the LED elements 62 at the time of image formation. For example, it is preferable that the sheet is skewed approximately one to five degrees (1-5°). Then, even if there are variances in optical elements of the image sensor 22 in the image reading section 20, effects of the variances in the optical elements are distributed. Thus, it is expected that effects of the variances in the optical elements are reduced.

So, the process advances from S107 in FIG. 8 to FIG. 13, and an image on a sheet is read (S201-S202). In the present embodiment, the reading method is preferably a method of moving the image sensor 22. That is, an image on a sheet placed on the contact glass 23 is read by moving the image sensor 22. For example, it is notified on the operation panel 40 to place the sheet in a slightly-skewed orientation.

If reading is completed and it is determined in S204 that the mark images 93, 94 are acquired normally (S204: Yes), the CPU 31 calculates skew of the sub-scanning direction at the reading process relative to the sheet conveying direction at the writing process, based on relative positional relationship between the corresponding mark images 93 and 94 (S401).

Then, the CPU 31 performs a determining process of determining whether the skew amount of the sheet calculated in S204 is larger than or equal to a predetermined threshold value (S402). Or, it may be determined whether the skew amount is within an appropriate range. This is because it is not preferable that the skew amount is too large. If it is determined that the skew amount is appropriate (S402: Yes), the pattern reading process is finished normally.

On the other hand, if it is determined that the skew amount is not appropriate (S402: No), it is preferable to again perform the pattern reading process so that the skew amount falls within the appropriate range. For example, the CPU 31 controls the operation panel 40 to display a screen for notifying the user to perform reading in a state where the sheet is skewed by a larger angle because the degree of skew is insufficient (S403). Further, the CPU 31 deletes the image data read in S201 (S206), and returns to the positional-deviation-amount acquiring process in FIG. 8.

That is, in the second embodiment, if it is determined in S402 that the sheet read in the pattern reading process is not skewed by an amount (angle) that is larger than or equal to the threshold value relative to the sub-scanning direction at the time of reading, no deviation amount is calculated based on the read image data. Or, in a modification, even if a deviation amount is calculated, the calculated deviation amount is nullified.

Also, in S108 of FIG. 8, if the skew of the sheet is insufficient, it is determined that the pattern reading process is not completed normally (S108: No). In the case of No in S402 in FIG. 13, it is determined that the pattern reading process is not completed normally because no image data is stored in the RAM 33, and the process returns to S106.

In the present embodiment, image data is read in a state where the sheet is skewed by an amount (angle) larger than or equal to the threshold value. Hence, image data read in a skewed state in the pattern reading process is corrected to be a straight position, and the deviation calculating process (FIG. 10) is performed for the image data subsequent to the correction. For example, after the image data is rotated by using the acquired block axis 97, a process of associating the pattern image 91 with the LED units 61 is performed. Or, the process may be performed for image data in a skewed state, and subsequently the skew may be corrected.

In the present embodiment, the pattern reading process is performed by moving the image sensor 22. However, reading may be performed by using an ADF, if a sheet can be moved in a state where the sheet is skewed appropriately.

[Image Forming Process]

Next, a positional-deviation correcting process at image formation in the MFP 100 will be described. In the MFP 100 in which the positional-deviation-amount acquiring process is executed, the amount of positional deviation is stored in the non-volatile memory 34 in the deviation calculating process. When an image forming process is performed in the MFP 100 in which the values are stored, the positional-deviation correcting process is performed by using the stored amount of positional deviation.

In the positional-deviation correcting process, for example, the light emitting timing or light emitting amount of the LED unit 61 is adjusted based on the amount of positional deviation for each block. Specifically, if there is positional deviation in the direction perpendicular to the arrangement direction of the LED elements 62, the light emitting timing of the LED unit 61 is adjusted. Further, if there is positional deviation of the LED elements 62 within the LED unit 61 in the direction perpendicular to the arrangement direction (see the skewed average pattern 98 in FIG. 12), the light emitting timing of each LED element 62 is adjusted.

Further, if there is positional deviation in the arrangement direction of the LED elements 62, the light emitting amount of the LED unit 61 is adjusted. For example, if a distance between the LED element 62 at an end of the LED unit 61 and the LED element 62 of another LED unit 61 closest to that LED element 62 is larger than assumption, the light emitting amounts of the LED elements 62 of the LED units 61 at both sides are increased. In contrast, if the distance is smaller than assumption, the light emitting amounts of the LED elements 62 of the LED units 61 at both sides are decreased. Further, as shown in the example of FIG. 12, if there is skew of the LED unit 61, both the light emitting timing and the light emitting amount of the LED unit 61 are adjusted. For example, if the average pattern 98 is skewed (that is, the LED unit 61 is skewed) as shown in FIG. 12, it is determined that the above-mentioned distance between the LED element 62 at the end of the LED unit 61 and the LED element 62 of the other LED unit 61 closest to that LED element 62 is larger than assumption.

As described above in detail, the MFP 100 of the present embodiment includes the image forming section 10 and the image reading section 20. The image forming section 10 includes the photosensitive member 51 and the exposing section 53 having the plurality of LED units 61. The image forming section 10 writes (forms), on a sheet, the pattern image 91 for detecting positional deviation of the LED units 61, the image reading section 20 reads the sheet, and the amounts of positional deviation of the LED units 61 are calculated based on the reading result. Positional deviation due to the LED units 61 subsequent to mounting is reflected in the pattern image 91 formed on the sheet. By reading the pattern image 91 and calculating positional deviation of the LED units 61, correction values reflecting positional deviation caused by mounting can be acquired. By using the calculated amounts of positional deviation at image formation, improvement of image quality and the like can be expected.

Conventionally, a manufacturer makes a light emitting unit having a plurality of LED units, and the manufacturer inspects the light emitting unit. Then, a light emitting unit is sold in a state where a memory storing the inspection result is built in the light emitting unit. In the MFP 100 of the present embodiment, inspection is performed in the MFP 100 after the light emitting unit 60 is mounted, and deviation amount is stored in the non-volatile memory 34 of the apparatus main body. Accordingly, it is not necessary to store the deviation amount in the light emitting unit 60 prior to mounting. That is, the light emitting unit 60 does not need to have a memory.

While the invention has been described in detail with reference to the above aspects thereof, it would be apparent to those skilled in the art that various changes and modifications may be made therein without departing from the scope of the claims.

For example, as well as an MFP, the invention can be applied to an apparatus such as a copier, a facsimile apparatus, etc. as long as the apparatus has both an image forming function and an image reading function.

For example, in the above-described embodiment, the LED unit 61 having the LED elements 62 and the driving circuit 63 is illustrated. However, it is also possible to use an LED unit having an array of LED elements to which an external driving circuit is attached. Further, in the above-described embodiment, the light emitting unit 60 has the plurality of LED units 61 that is arranged and combined. However, the light emitting unit may be a single continuous LED unit in which LED elements are arranged.

For example, in the above-described embodiment, a range corresponding to one LED unit 61 is defined as a block. However, a range corresponding to a plurality of LED units 61 may be defined as one block. Or, calculation may be performed for the entirety of the light emitting unit 60 as one block, without dividing into a plurality of blocks.

For example, in the above-described embodiment, the difference between the average position of each pattern image 91 and the aggregate average value is obtained as the amount of positional deviation. However, predetermined master data (for example, an ideal Y coordinate of the average position of the pattern image 91) is preliminarily stored as a target for comparison. Then, a difference between the average position of each pattern image 91 and the master data may be obtained as the amount of positional deviation. Further, for example, it is possible to determine whether the MFP 100 is good or bad, based on the calculated amount of positional deviation.

For example, if an MFP further has a configuration for passing, to the image reading section 20, a sheet on which the position correction pattern 71 is formed by the image forming section 10, the MFP is capable of automatically performing all the steps from formation of the patterns to calculation of the amount of positional deviation, which is preferable.

For example, a person who executes the positional-deviation-amount acquiring process is not limited to an administrator of manufacture. For example, the positional-deviation-amount acquiring process may be performed on the MFP 100 after the MFP 100 is sold, at the time when a service person etc. performs a maintenance and inspection service. For example, when the light emitting unit 60 is replaced, it is preferable to execute the positional-deviation-amount acquiring process. Also, the positional-deviation-amount acquiring process may be executed when an end user replaces the light emitting unit 60.

For example, the invention may be applied to a combination of an LED-type printer not having an image reading section and a reading device such as a scanner etc. having an image reading section. For example, a pattern image for detecting positional deviation of an LED unit is formed on a sheet by the printer, and the sheet is read by the reading device. Based on the reading result, the amount of positional deviation of the LED unit of the printer may be calculated. And, the calculated amount of positional deviation may be stored in the printer.

The processes disclosed in the embodiment may be executed by hardware such as a single CPU, a plurality of CPUs, an ASIC etc., or a combination thereof. Further, the processes disclosed in the embodiment may be realized in various modes such as a recording medium storing program instructions for executing the processes, a method of executing the processes, and the like.

What is claimed is:

1. An image processing device comprising:

an image forming section comprising:

a conveyer configured to convey a sheet in a sheet conveying direction;

a bearing member configured to bear an image; and a light-emitting-element array having a plurality of light emitting elements arranged linearly in an arrangement direction that is perpendicular to the sheet conveying direction, the image forming section being configured to form an image on the bearing member by using the plurality of light emitting elements to form the image on a sheet;

a reader configured to read an image formed on the sheet;

a processor; and a memory storing instructions, the instructions, when executed by the processor, causing the processor to perform:

a pattern writing process of controlling the image forming section to form a pattern image on the sheet, the pattern image being an image for detecting positional deviation of the light-emitting-element array;

a pattern reading process of controlling the reader to read as image data the pattern image formed on the sheet by the pattern writing process;

a dividing process of dividing the pattern image read in the pattern reading process into a plurality of blocks in the arrangement direction of the plurality of light emitting elements; and a deviation calculating process of calculating an amount of positional deviation of the light-emitting-element array in the sheet conveying direction, for each of the plurality of blocks, wherein the light-emitting-element array comprises a plurality of light-emitting-element arrays, wherein the processor is configured to, in the deviation calculating process, calculate the amount of positional deviation of each of the plurality of light-emitting-element arrays in the sheet conveying direction, wherein the processor is configured to, in the pattern writing process, control the image forming section to form, on a sheet, the pattern image formed by neighboring ones of the plurality of light-emitting-element arrays, at positions different from each other with respect to the sheet conveying direction, and wherein the processor is configured to, in the pattern writing process, control the image forming section to form mark images for position recognition on the sheet, the mark images being formed by using a same light emitting element as the pattern image and located at an upstream side and a downstream side of the pattern image in the sheet conveying direction so that the pattern image is interposed between the mark images.

2. The image processing device according to claim 1, wherein the processor is configured to perform:

a position calculating process of calculating an average position of the image data in the sheet conveying direction, for each of the plurality of blocks, and wherein the processor is configured to, in the deviation calculating process, calculate the amount of positional deviation of the light-emitting-element array in the sheet conveying direction, based on a difference of the average position for each of the plurality of blocks.

3. The image processing device according to claim 2, wherein the processor is configured to, in the deviation calculating process, calculate the amount of positional deviation of the light-emitting-element array in the sheet conveying direction, based on a difference between the average position for each of the plurality of blocks calculated in the position calculating process and an average position calculated for all regions of the image data.

4. The image processing device according to claim 3, wherein the light-emitting-element array comprises a plurality of light-emitting-element arrays, and wherein each of the plurality of blocks corresponds to one of the plurality of light-emitting-element arrays.

5. The image processing device according to claim 1, wherein the light-emitting-element array comprises a plurality of light-emitting-element arrays, and wherein the processor is configured to, in the deviation calculating process, calculate the amount of positional deviation of each of the plurality of light-emitting-element arrays in the sheet conveying direction.

6. The image processing device according to claim 1, wherein the processor is configured to, in the pattern writing process, control the image forming section to form the pattern image of a length greater than or equal to a peripheral length of the bearing member in the sheet conveying direction.

7. The image processing device according to claim 1, wherein the light-emitting-element array comprises a plurality of light-emitting-element arrays, wherein the processor is configured to perform a dividing process of dividing image data read in the pattern reading process into a plurality of blocks in the arrangement direction, and wherein the processor is configured to, in the dividing process, acquire positions of the mark images and acquire a position of a block axis based on the positions of the mark images, the block axis being a center line, for each of the plurality of blocks, that connects a center position of the mark image at the upstream side and a center position of the mark image at the downstream side.

8. The image processing device according to claim 1, wherein the pattern image formed by the plurality of light-emitting-element arrays is divided into a plurality of blocks consisting of a first block and a second block arranged alternately in the arrangement direction, each of the plurality of blocks corresponding to one of the plurality of light-emitting-element arrays;

wherein the pattern image in each of the plurality of blocks includes dot patterns that are formed by a corresponding one of the plurality of light-emitting-element arrays;

wherein the dot patterns of the pattern image in the first block are arranged at equally-spaced positions including both ends of the pattern image in the sheet conveying direction; and wherein the dot patterns of the pattern image in the second block are arranged at intermediate positions, in the sheet conveying direction, of the dot patterns in the first block.

9. The image processing device according to claim 1, wherein the processor is configured to, in the pattern writing process, control the image forming section to form, on a sheet, the pattern image of each of the plurality of light-emitting-element arrays at such positions that average positions of the pattern image of the plurality of light-emitting-element arrays in the sheet conveying direction are same with respect to the sheet conveying direction.

10. The image processing device according to claim 1, wherein the processor is configured to, in the pattern writing process, control the image forming section to form, on a sheet, the pattern image by using a predetermined one of the plurality of light-emitting-element of the light-emitting-element array, a number of the predetermined one of the plurality of light-emitting-elements being smaller than a number of all the light emitting elements of the light-emitting-element array.

11. The image processing device according to claim 10, wherein the predetermined one of the plurality of light emitting elements includes light emitting elements located at both ends of the light-emitting-element array.

12. The image processing device according to claim 11, wherein the processor is configured to, in the deviation calculating process, calculate amounts of positional deviation of the light emitting elements located at the both ends of the light-emitting-element array, and wherein the processor is configured to perform a storing process of storing an average value of the amounts of positional deviation of the light emitting elements located at the both ends of the light-emitting-element array as the amount of positional deviation of the light-emitting-element array if a difference between the amounts of positional deviation in the sheeting conveying direction is within an acceptable range, and storing the amounts of positional deviation of at least light emitting elements located at the both ends if the difference between the amounts of positional deviation is outside the acceptable range.

13. The image processing device according to claim 1, wherein the processor is configured to perform:

a determining process of determining whether the sheet read in the pattern reading process is skewed by an amount larger than or equal to a threshold value relative to a sub-scanning direction of the reader; and a nullifying process of nullifying the amount of positional deviation calculated in the deviation calculating process, in response to determination in the determining process that the sheet read in the pattern reading process is not skewed by the amount larger than or equal to the threshold value.

14. The image processing device according to claim 1, wherein the processor is configured to perform a light-emitting-amount adjusting process of adjusting an amount of light emission of the plurality of light emitting elements, based on the amount of positional deviation in the arrangement direction calculated in the deviation calculating process.

15. The image processing device according to claim 1, wherein the processor is configured to perform a timing adjusting process of adjusting lighting timing of the plurality of light emitting elements, based on the amount of positional deviation in the sheet conveying direction calculated in the deviation calculating process.

16. A method of acquiring an amount of positional deviation of a light-emitting-element array mounted on an image processing device, the light-emitting-element array having a plurality of light emitting elements arranged linearly in an arrangement direction that is perpendicular to a sheet conveying direction, the method comprising:

controlling an image forming section to form a pattern image on a sheet, the pattern image being an image for detecting positional deviation of the light-emitting-element array;

controlling a reader to read the pattern image formed on the sheet;

dividing the pattern image read by the reader into a plurality of blocks in the arrangement direction of the plurality of light emitting elements; and calculating an amount of positional deviation of the light-emitting-element array in the sheet conveying direction for each of the plurality of blocks, wherein the light-emitting-element array comprises a plurality of light-emitting-element arrays, wherein the calculating comprises calculating the amount of positional deviation of each of the plurality of light-emitting-element arrays in the sheet conveying direction.

wherein the pattern image is formed by neighboring ones of the plurality of light-emitting-element arrays, at positions different from each other with respect to the sheet conveying direction, and wherein the pattern writing process comprises controlling the image forming section to form mark images for position recognition on the sheet, the mark images being formed by using a same light emitting element as the pattern image and located at an upstream side and a downstream side of the pattern image in the sheet conveying direction so that the pattern image is interposed between the mark images.

17. The image processing device according to claim 1, wherein, in the pattern writing process, the processor is configured to control the image forming section to form the pattern image on the sheet such that a length of the pattern image in the arrangement direction corresponds to an entire exposure range of the light-emitting-element array.

18. An image processing device comprising:

an image forming section comprising:

a bearing member configured to hear an image; and a light-emitting-element array having a plurality of light emitting elements arranged linearly in an arrangement direction, the image forming section being configured to form an image on the bearing member by using the plurality of light emitting elements to form the image on a sheet;

a reader configured to read an image formed on a sheet;

a processor; and a memory storing instructions, the instructions, when executed by the processor, causing the processor to perform:

a pattern reading process of controlling the reader to read the sheet on which a pattern image is formed, the pattern image being an image for detecting positional deviation of the light-emitting-element array; and a deviation calculating process of calculating an amount of positional deviation of the light-emitting-element array based on a reading result by the pattern reading process, wherein the image forming section further comprises a conveyer configured to convey the sheet in a sheet conveying direction, wherein the processor is configured to perform a pattern writing process of controlling the image forming section to form the pattern image on the sheet, and wherein the processor is configured to, in the pattern writing process, control the image forming section to form, on the sheet, a pattern image by using a predetermined one of the plurality of light emitting elements of the light-emitting-element array, a number of the predetermined one of the plurality of light emitting elements being smaller than a number of all the light emitting elements of the light-emitting-element array and wherein the processor is configured to, in the pattern writing process, control the image forming section to form mark images for position recognition on the sheet, the mark images being formed by using a same light emitting element as the pattern image and located at an upstream side and a downstream side of the pattern image in the sheet conveying direction so that the pattern image is interposed between the mark images.

* * * * *